United States Patent [19]

Taber

[11] Patent Number: 4,948,142

[45] Date of Patent: Aug. 14, 1990

[54] GOLD POSITION TRAINING DEVICE

[76] Inventor: Donald J. Taber, 400 SW. 18th Ct., Pompano Beach, Fla. 33060

[21] Appl. No.: 441,326

[22] Filed: Nov. 22, 1989

Related U.S. Application Data

[63] Continuation-in-part of Ser. No. 324,739, Mar. 17, 1989, abandoned.

[51] Int. Cl.[5] ..... A63B 69/36

[52] U.S. Cl. ..... 273/183 B; 273/188 R; 273/189 R; 273/186 R; 273/187 A

[58] Field of Search ..... 273/183 B, 186 R, 186 C, 273/190 R, 191 R, 191 A, 191 B, 192, 183 D, 188 R, 189 R, 189 A, 190 R

[56] References Cited

U.S. PATENT DOCUMENTS

| | | | |
|---|---|---|---|
| 1,854,392 | 4/1932 | Bambrick | 273/190 R |
| 3,698,721 | 10/1972 | Stewart | 273/190 R |
| 4,659,084 | 4/1987 | Vuick | 273/190 R |
| 4,758,000 | 7/1988 | Cox | 273/190 R |
| 4,817,954 | 4/1989 | Kubo | 273/183 B |

*Primary Examiner*—George J. Marlo
*Attorney, Agent, or Firm*—Joseph Zallen

[57] ABSTRACT

An apparatus for assisting a golfer to develop a proper position and swing for his golf club, comprising in combination a platform having an area on which the golfer stands, positioners for the hips and neck of the golfer, and a swing control (40) (140) which includes an open space through which the golfer's hands can pass.

4 Claims, 4 Drawing Sheets

GOLD POSITION TRAINING DEVICE

This application is a continuation-in-part of Ser. No. 324,739, filed Mar. 17, 1989, now abandoned.

BACKGROUND OF INVENTION

This invention relates to an apparatus for assisting the golfer in developing proper habits for body positioning and swing of the golf club.

The prior art includes a number of devices to assist the golfer in developing a proper club swing, as for example U.S. Pat. Nos. 4,134,589, 4,479,653, 4,653,757, 4,662,640, and Re. 32,397. However, none of these devices provide training for body position.

One object of the present invention is to provide a single apparatus which enables a golfer to develop the proper habits for body stance and golf club swing.

Other objects and advantages of this invention will be apparent from the description and claims which follow, taken together with the appended drawings.

SUMMARY OF INVENTION

The invention comprises generally the combination of a platform and a vertical support means. Attached to the vertical support means are an adjustable horizontal arm means which abuts the right hip of the golfer, an adjustable horizontal arm means which abuts the left hip of the golfer, and an upper adjustable horizontal arm means abutting the neck of the golfer. The platform has a front portion on which a golf ball can be positioned in the desired location. The platform's main portion where the golfer places his feet is marked off, as for example, in inches for repeated proper placement. One important feature of this invention is the adjustability as to body build and arm length. The vertical support means is preferably positioned either on the sides or in the rear of the platform so as not to interfere with the golfer's swing.

SPECIFIC EXAMPLES OF INVENTION

Figure 1:
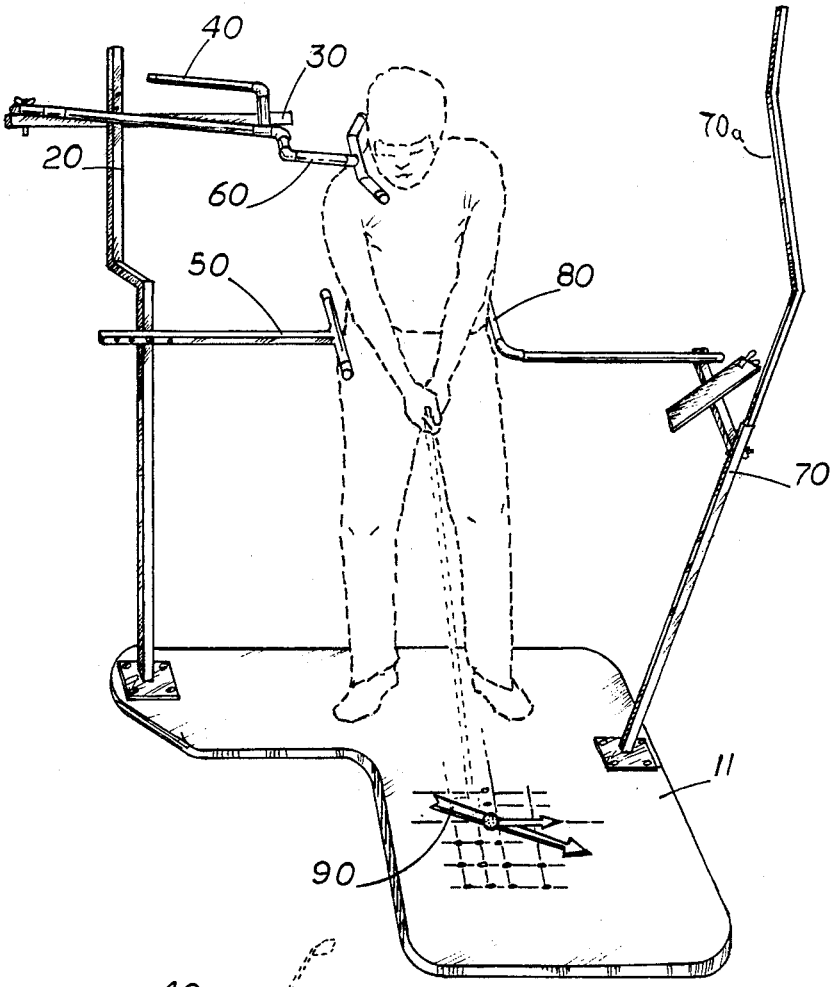
FIG. 1 is a front perspective view showing one embodiment of the invention with a golfer illustrated in phantom ready to begin his swing.
Figure 2:
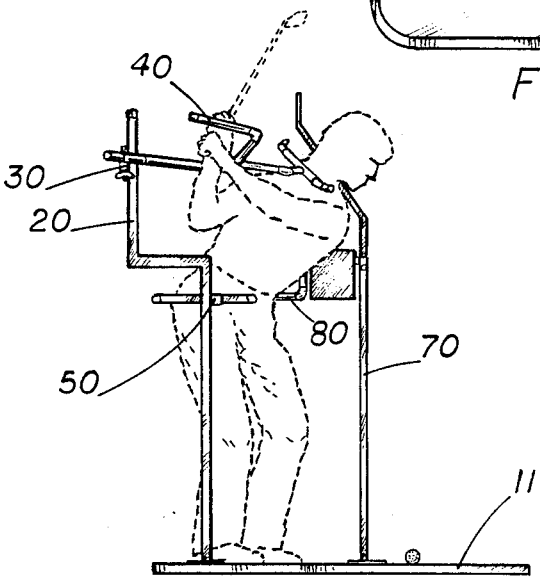
FIG. 2 shows a side view of the golfer who has reached the top of his swing.
Figure 3:
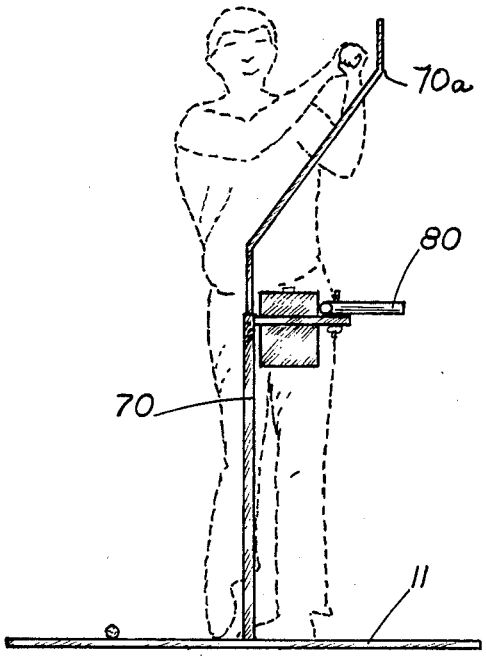
FIG. 3 shows the golfer completing his swing.

Referring now to the drawings, the illustrated embodiment shows a platform 11, on which the golfer stands. The platform has a front portion having holes for tees in various positions which enable different adjustments to be made of distances from the golfer to the ball, suiting the particular golfer's height and weight. Also shown is a "Y" type imprinted doubleheaded arrow 90, one part of which indicates the intended proper path of the head of the golf club, and the other the intended direction of the golf ball after it has been struck by the club head. The portion of the platform where the golfer places his feet is marked off in inches from a center point outwardly on both sides, with parallel and perpendicular lines to the intended target line and target.

On one side of the platform, forward of the golfer, is a vertical upright 70 to which is adjustably attached an L-shaped bar 80 intended to abut one hip of the golfer. The top portion 70*a* of the vertical upright 70 adjusts upward and downward to accommodate the height and arms' length of the golfer for his follow-through of the golf swing. On the other side of the golfer, more or less in line with his heels, is another vertical upright 20, to which is adjustably attached a T-bar 50 which adjusts both vertically and horizontally to abut the other hip of the golfer. Mounted on upright 20 in line with the head portion is an adjustable arm 60 intended to abut the neck of the golfer. An L-shaped bar 40 is mounted on bar 60 so as to provide a U-shaped cavity through which the club and the hands of the golfer pass when he is at the top of the swing and the swing is proper. Bar 60 is adjustable at both ends; i.e. at the neck abutting end it adjusts to the diagonal angle of the golfer's shoulders, and its other other end horizontally to facilitate a preferably maximum two-inch torso list to the right. Bar 60 is adjustably attached to bar 30 which is adjustably attached to bar 20. Bar 30 adjusts vertically on bar 20 to accommodate the shoulder height of the golfer, standing in an upright position.

Figure 4:
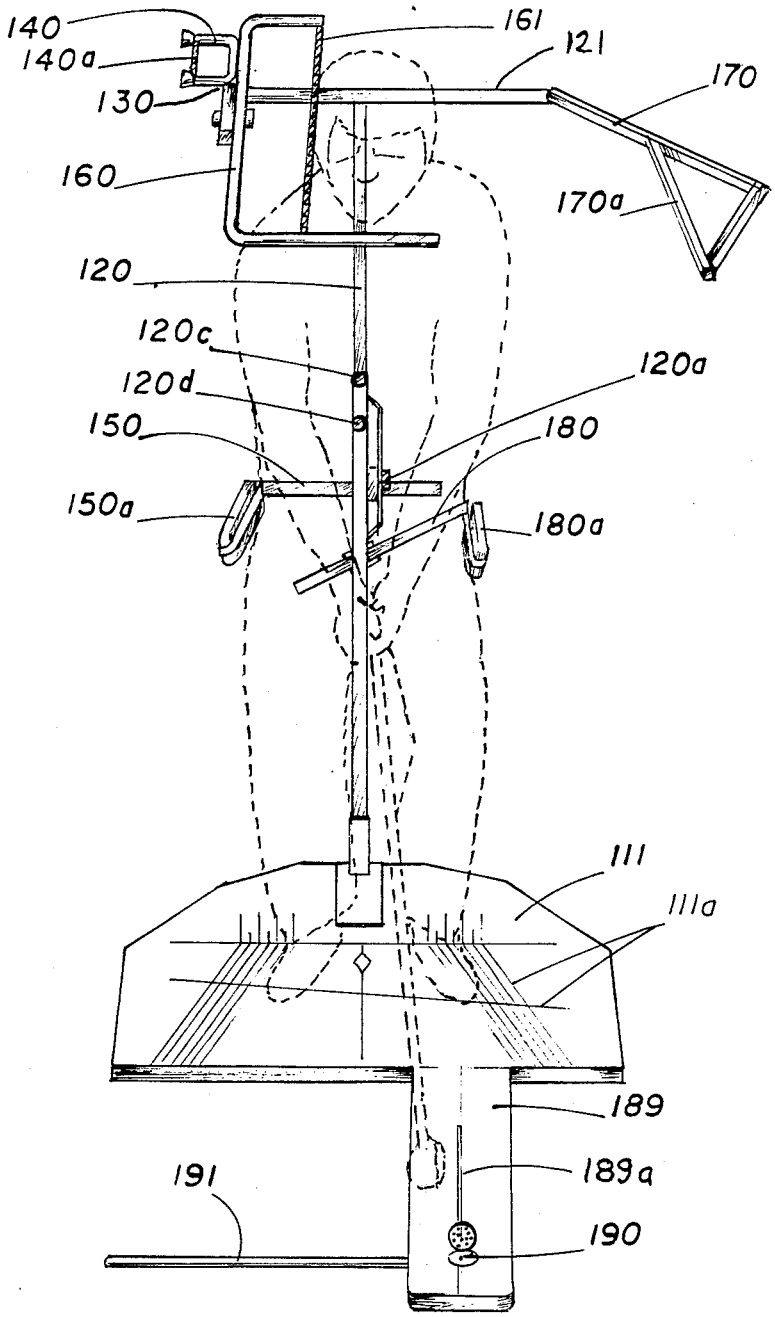
FIG. 4 is a front perspective view showing a second embodiment of the invention with a golfer illustrated in phantom ready to begin his swing.
Figure 5:
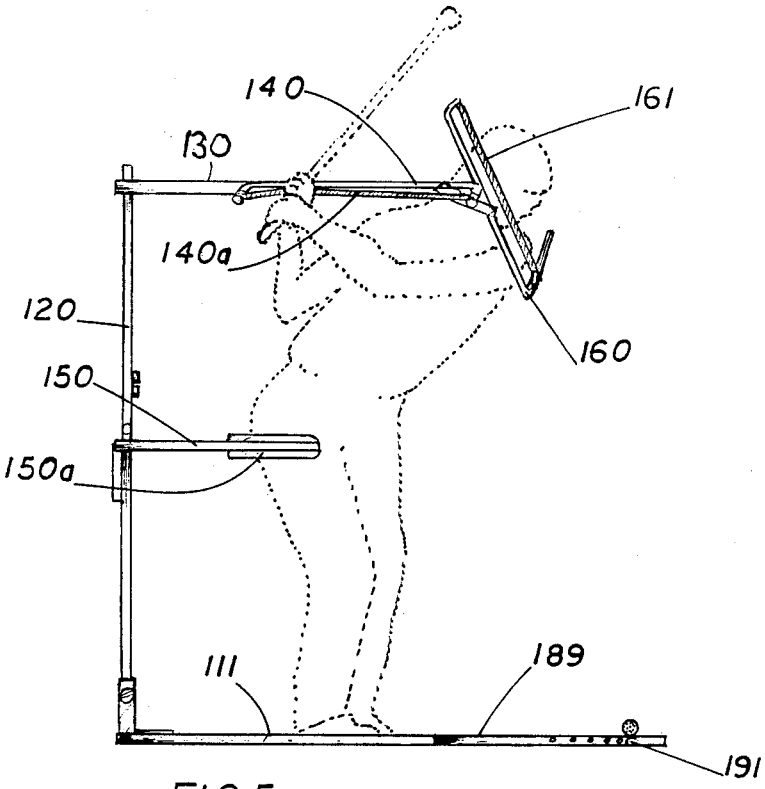
FIG. 5 shows a side view of FIG. 4 of the golfer who has reached the top of his swing.
Figure 6:
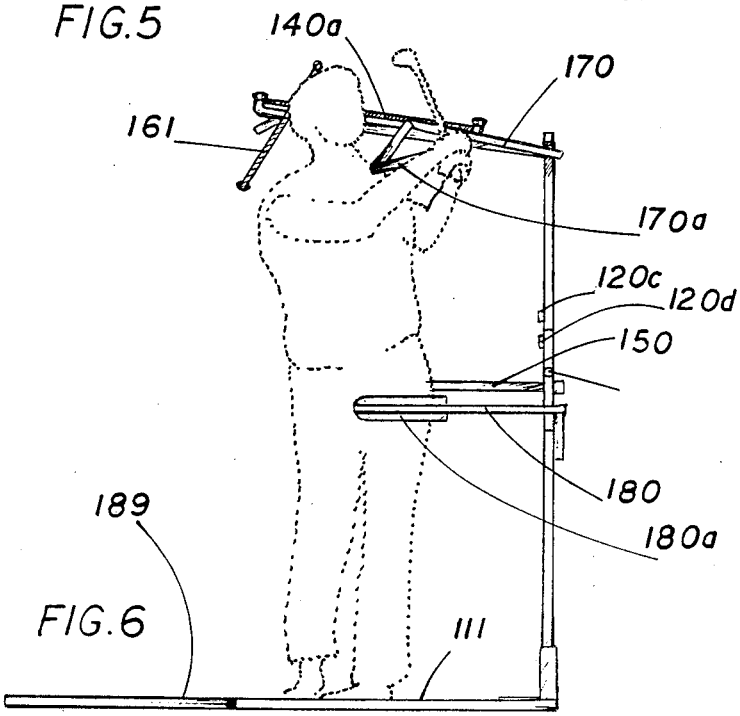
FIG. 6 shows the golfer in FIG. 5 completing his swing.

In another embodiment of this invention, illustrated in FIGS. 4, 5 and 6, there is a single telescoping vertical support 120 attached to the rear of the platform 111 so that the golfer's standing area on platform 111 is in front of the support. Adjustable hip positioners 150 and 180 extend horizontally from post 120. Neck positioner 160 is adjustable and has a tension cord 161 which contacts the side of the neck. Hip-positioner 150 is adjustable by means of knob 120*a* and has a hip-contacting pad 150*a*. Hip-positioner 180 is adjustable by means of knob 120*b* and has a hip-contacting pad 180*a*. The height of vertical support 120 is adjustable by knobs 120*c* and 120*d*.

Horizontal bar 121 on the top of vertical support 120 supports arm 130 on one side and arm 170 on the other. Mounted on arm 130 is adjustable neck positioner 160 having a tension cord 161 for contacting the neck. Also mounted on arm 130 is U-shaped bar 140 with a tension cord 140*a*, which define a cavity. The hands and club of the golfer should pass through the cavity at the top of the swing if the swing is proper.

On the arm 170 is a follow-through guide 170*a* which helps train the golfer as to the limit of his swing. The platform 111 has an extension 189 with a slot 189*a* in which a horizontal bar 191 is slidably positioned. A support 190 for the golf ball is mounted on the bar above the slot.

In addition to the angular arrangement of neck positioning means 160 and swing control 140 illustrated in FIGS. 4–6, these can be in the same plane, and bar 160 can directly telescope into the end of bar 121.

I claim:

1. An apparatus for assisting a golfer to develop a proper position and swing for his golf club, comprising in combination:

(a) a platform (111);

(b) vertical support means (120) attached to the platform (111);

(c) first hip positioning means (150) extending horizontally from said vertical support means (120);

(d) second hip positioning means (180) extending in a generally opposite direction horizontally from said vertical support means (120);

(e) neck contacting means (161) supported by neck positioning means (160) extending from said vertical support means (120), and (f) swing control limiter means (140) including a bounded open portion extending from said vertical support means (120) which defines an opening through which the golfer's hands can pass at the top of the backswing.

2. The apparatus of claim 1 which includes follow-through guide means (170*a*) which marks the follow-through position of a proper golf stroke.

3. The apparatus of claim 1 wherein said vertical means, hip positioning means, neck positioning means, and swing control limiter means are adjustable to conform to the physical build of the golfer.

4. The apparatus of claim 1 wherein said vertical support means (120) includes horizontal support means 130 to which said neck positioning means 160 is attached.

* * * * *